United States Patent [19]

Holmes

[11] 4,261,146

[45] Apr. 14, 1981

[54] BULKHEAD STRUCTURE

[75] Inventor: Ronald Holmes, Stoney Brook, N.Y.

[73] Assignee: Advanced Structures, Corp., Deer Park, N.Y.

[21] Appl. No.: 40,418

[22] Filed: May 18, 1979

Related U.S. Application Data

[63] Continuation-in-part of Ser. No. 942,483, Sep. 15, 1978, Pat. No. 4,238,913.

[51] Int. Cl.[3] ..... E04H 1/00

[52] U.S. Cl. ..... 52/238; 52/393; 52/582; 52/587; 114/116

[58] Field of Search ..... 52/238, 241, 242, 243, 52/274, 278, 279, 393, 399, 402, 403, 455, 457, 474, 475, 515, 516, 580, 582, 589, 394, 395, 587; 49/DIG. 1; 114/116

[56] References Cited

U.S. PATENT DOCUMENTS

| | | | |
|---|---|---|---|
| 2,333,289 | 11/1943 | Bohnsack | 114/116 X |
| 2,746,097 | 5/1956 | Tofani | 49/DIG. 1 |

FOREIGN PATENT DOCUMENTS

| | | | |
|---|---|---|---|
| 612720 | 1/1961 | Canada | 52/393 |
| 1122504 | 5/1956 | France | 52/393 |

*Primary Examiner*—J. Karl Bell

[57] ABSTRACT

A bulkhead structure for partitioning a deck comprises a bulkhead panel for partitioning the deck. The bulkhead panel has an elongated slot therein. A base member is affixed to the deck and received within the elongated slot for supporting the bulkhead panel. Corrosion prevention apparatus between the bulkhead panel and the base member inhibits corrosion of the bulkhead structure.

12 Claims, 6 Drawing Figures

FIG. 5
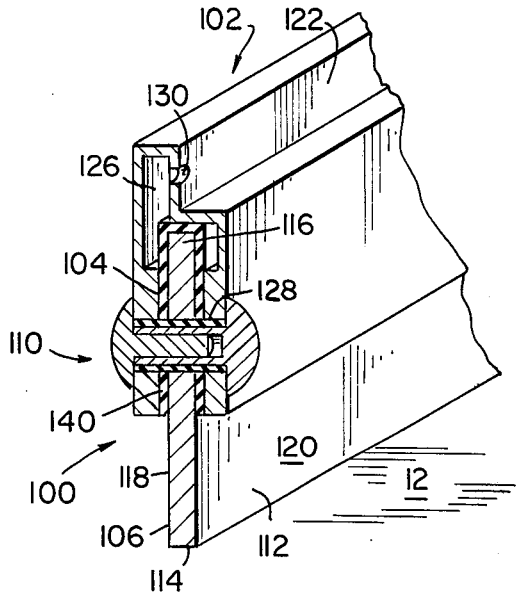
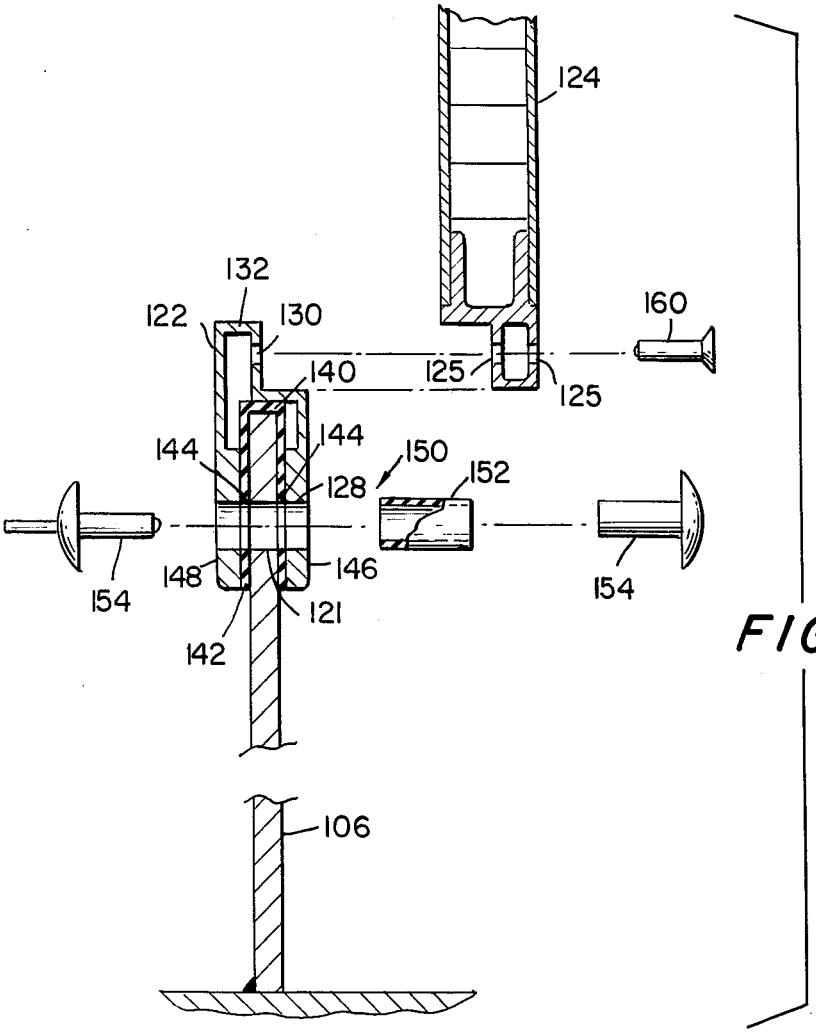
FIG. 6

BULKHEAD STRUCTURE

CROSS REFERENCES TO RELATED APPLICATIONS

This application is a continuation-in-part of a copending U.S. Pat. application Ser. No. 942,483, filed Sept. 15, 1978, now U.S. Pat. No. 4,238,913 to the same inventor.

BACKGROUND OF THE INVENTION

While the invention is subject to a wide range of applications, it is especially related to bulkhead structures for ships and specifically to panel-type construction and will be particularly described in that connection. In the bulkhead structure art, it is known to provide aluminum honeycomb construction panels mounted within base members ("U" channels) directly to the decks of a ship. Such construction, while providing the desired lightweight strength, often results in corrosion due to the dissimilar aluminum to steel metal construction (between the construction panels and case members) in the presence of water or humidity. Further, the bulkheads are often used to ground the electrical system in ships and the current co-acting with sea water on the decks causing additional corrosion problems. Also, the base member which receives and supports the construction panels is open and may trap water therein whereby the problems of corrosion are increased. Further, it is generally extremely difficult to pre-assemble bulkhead members for a number of reasons. The decks are usually not level and when open U-shaped base members support the bulkhead panels, it is often difficult to obtain and maintain the precise alignment required when the base members are welded to the deck. In addition, the split H-shaped or H-shaped plates between bulkhead panels which allow for easy disassembly cannot be mounted until the bulkhead panels are installed into the U-shaped base member.

Panel constructions of various types have been proposed in different types of construction operations. Exemplarly of such prior art constructions are U.S. Pat. No. 3,337,756 to Polhamus; U.S. Pat. No. 3,830,027 to Paisley; U.S. Pat. No. 4,051,641 to Elliott; U.S. Pat. No. 3,983,670 to Lightfoot; U.S. Pat. No. 3,913,292 to Braekkan; and U.S. Pat. No. 2,048,153 to Wollaeger.

It is the object of the present invention to provide a bulkhead structure wherein the base member and bulkhead panel of dissimilar metals are joined together to substantially inhibit corrosion.

It is the object of the present invention to provide a bulkhead structure wherein the bulkhead structure may be preassembled.

It is a further object of the present invention to provide a bulkhead structure which is relatively easy to assemble and dissassemble.

It is a further object of the present invention to provide a bulkhead structure which is relatively inexpensive to erect.

SUMMARY OF THE INVENTION

In accordance with the present invention, there is disclosed a bulkhead structure for partitioning a deck comprising a bulkhead panel for partitioning the deck. The bulkhead panel has an elongated slit therein. A base member is affixed to the deck received within the elongated slot for supporting the bulhead panel. Corrosion prevention apparatus between the bulkhead panel and the base member inhibits corrosion of the bulkhead structure.

For a better understanding of the present invention, together with other and further objects thereof, reference is made to the following description, taken in connection with the accompanying drawings, while its scope will be pointed out in the appended claims.

BRIEF DESCRIPTION OF THE DRAWINGS

FIG. 5 is a plan view illustrating a bulkhead structure having a channel bar; and FIG. 6 is a side view, partly in cross-section, of a bulkhead structure in accordance with the third embodiment of the present invention.

DESCRIPTION OF THE PREFERRED EMBODIMENTS

Figure 2:
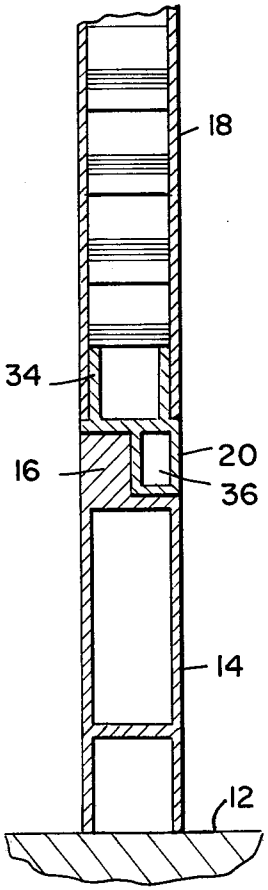
FIG. 2 is a view taken on Line 2—2 FIG. 1.
Figure 1:
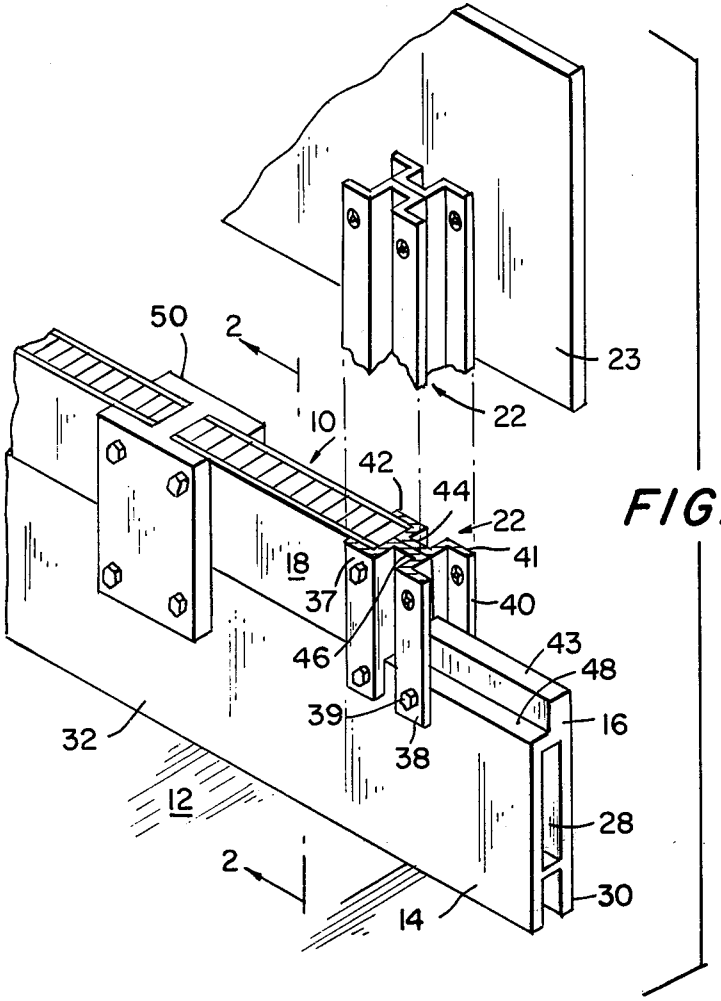
FIG. 1 is an illustration of a bulkhead structure with a plate affixing the upper and lower panels in accordance with the present invention.
Figure 4:
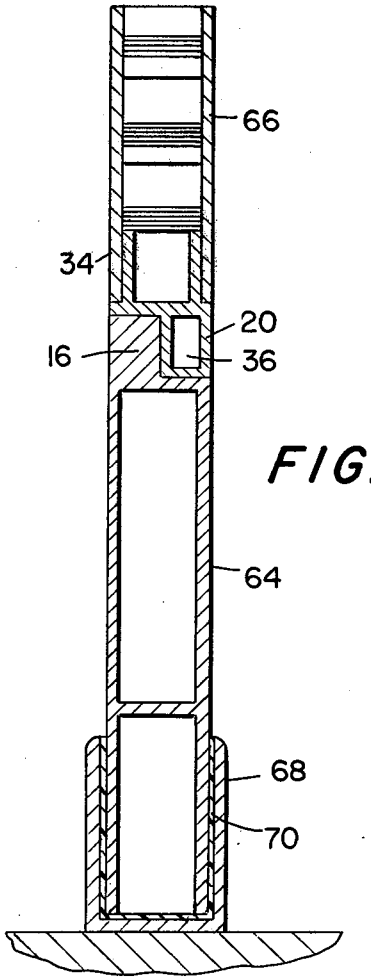
FIG. 4 is a view taken on Line 4–4 of FIG. 3.

In accordance with the present invention, as shown in FIGS. 1 and 2, a lower panel member 14 having an L-shaped portion 16 is affixed to a deck 12. An upper panel member 18 has an L-shaped portion interfitting in the L-shaped portion 16 of the lower panel member 14 whereby the upper panel member is supported by the lower panel member. A plate element 22 for affixing the panel members 14 and 18 to each other is fastened to an overhead structure 23 (a section of metal attached to the ceiling structure of the ship, the coaming), and to the lower panel members. A second embodiment includes a bulkhead panel 64 being constituted of a first metal. A base member 68 constituted of a second metal is affixed to the deck for receiving the bulkhead panel. Polymeric material 70 is disposed between the panel and the base member to prevent contact of the first and second metals in order to substantially prevent corrosion.

Referring to FIG. 1, there is illustrated a bulkhead structure 10 for partitioning a deck 12. A lower panel member 14 has an L-shaped portion 16 and is affixed to the deck 12 by any suitable means, such as for example welding. The panel member 14 has hollow cross-section 28 which may be of any desirable shape such as for example a rectangle, as shown. The member 14 includes an L-shaped portion 16 and is completely closed with the exception of end 30.

An upper panel member 18, as best seen in FIG. 2, has an L-shaped portion 20 affixed thereto. Member 18 is constructed of an aluminum honeycombed panel in order to reduce the weight and still provide strength. However, it is within the scope of the present invention to use a panel of any desirable material and construction. The bottom portion 34 of panel 18 is provided with an L-shaped portion 20 which may be affixed to the panel member by any suitable means, such as for example fasteners. The L-shaped portion is completely closed along its length and may have a hollow cross-section of any desirable shape, such as for example, a rectangular, as shown. This L-shaped portion 20 interfits with the L-shaped portion 16 of the lower panel member in order that the upper panel member 18 is supported by the lower panel member 14.

A plate member 22 affixes the panel members to each other by being fastened at end 37 to the upper member and at the end 38 to the lower panel member, whereby the L-shaped interfit is bridged. The fastening may be by any desirable means such as for example bolts 39. The plate member may be of different types such as a split H-post 40, as shown. H-post 40 is constructed of two U-shaped sides 41 and 42 which are joined by two connecting walls 44 and 46. The side of the H-post adjoined to the wall 44 is shaped in order that it will accommodate wall 43 of the L-shaped portion 16 while the side of the H-post adjoined to the connecting wall 46 is shaped to accomodate the lower wall 48 on panel member 14. The plate element 22 may be a solid H-post 50 which is used in conjunction with a split H-post, as will be explained.

In constructing a bulkhead structure 10, a lower panel member 14 is first affixed to the deck 12 by any means such as welding. Since this member is closed, no water can enter into it except through the end 30 which may be closed or sealed in any desirable manner such as abutting them against another bulkhead. Next, an upper panel member 18 can be installed on the lower panel member by interfitting L-shaped portions 16 and 20 as seen in FIG. 2.

Another feature of this invention is that the lower panel members can be pre-assembled, such as for example, by placing lower panel 62 in place between corner sections 63 and 65 (see FIG. 3) and, if desired, the split and solid H-sections may be attached to the lower panel member. The upper panels may be placed in position at a subsequent time. The relative ease of joining the upper and lower panels due to the L-shaped interfit permits the major part of the structure to be assembled and properly positioned in advance. Previously, this could not be done because the corner members and the H-sections were supported by the upper panel (there was no lower panel). When the upper panels were not yet installed, the corner members and H-sections could not support themselves and pre-assembly was not feasible. This latter consideration meant that the honeycomb panels had to be installed during the initial stages of construction. The panels therefore were often damaged because they were exposed during the remainder of the construction of the object (i.e., a ship).

The lower panel member 14 may actually be 4 to 6 inches high; however, the invention is not limited to this dimension. The upper panel member 18 may extend to a ceiling above the deck 12. It can readily be seen that the split H-post installed between every other set of wall panels allows a panel to be removed as required. Thus, if a repair or the like behind a wall member such as 18 is necessary, one half of the split H-post 40 may be removed and thereby permit the removal of wall 18 from the solid H-post 50.

In addition, the closed lower panel member 14 may be sealed at the ends as explained above. This prevents water from collecting in any part of the bulkhead structure and thereby corrosion problems are substantially reduced.

Figure 3:
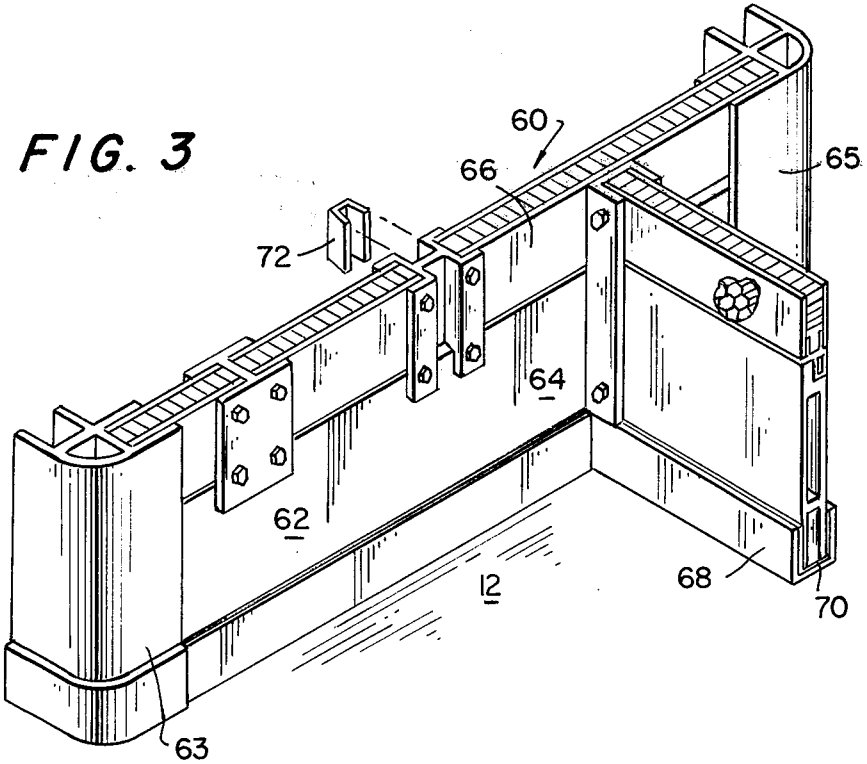
FIG. 3 is an illustration of bulkhead structure wherein a panel member is received in a base member.

Referring to FIG. 3, a second embodiment of a bulkhead structure 60 is illustrated. A bulkhead panel element 62 is constituted of a first metal such as for example aluminum. Also, this bulkhead panel element 62 may be comprised of two portions, a lower panel member 64 and an upper panel member 66. As explained in the first embodiment, both of these panels are frequently made of aluminum. The upper panel 66 may be honeycombed in order to achieve weight reduction while providing the desired strength. The entire bulkhead panel 62 is supported by a U-shaped base member 68 which may be constituted of a second metal such as for example steel. The base member is affixed to a deck 12 by any suitable means such as for example welding. The U-shaped member 68 receives bulkhead panel element 62 and a polymeric material, such as for example, Nylon. This polymeric material 70 is disposed between element 62 and member 68 in order to prevent contact between the first and second metals and thereby substantially preventing corrosion. If the aluminum metal was in direct contact with the steel base member and/or the deck, a galvanic action caused by water in contact with the different metals would lead to serious corrosion problems. Further, the bulkhead is often used to ground electrical systems in ships, and the current is now prevented from grounding to the deck and electrolytic corrosion is inhibited.

A third embodiment of the present invention is illustrated in FIG. 5. A bulkhead structure 100 includes a lower bulkhead panel means 102 which is similar to the bulkhead panel element 62, as shown in the second embodiment described in FIG. 3. The bulkhead panel 102 partitions the deck and includes an elongated slot 104 therein. A base member 106 is affixed to the deck and is received within the elongated slot 104 for supporting the bulkhead panel 102. Corrosion prevention apparatus 110 is provided between the bulkhead panel 102 and the base member 106 for inhibiting corrosion of the bulkhead structure.

The base member 106, known as deck coaming, may be formed of an elongated plate having a substantially rectangular cross-section with a first side 114 of the base member being affixed to the deck 12 in any convenient manner such as for exmaple, welding. Although it is preferable to form the base member with a rectangular configuration, it is within the scope of the present invention for form it of other shapes, such as for example, a T-shape. The base member has a second side 116 opposite said first side 114 and third and fourth sides 118 and 120, respectively. Holes 121 are provided along the length of the base member as desired. The base member is preferably constructed of steel, but may be made of any other desired material, such as for example, aluminum.

The panel means 102 comprised of a lower panel member 122 and an upper panel member 124 which is substantially identical to upper member 18 of FIG. 2 with the L-shaped portion 20. The lower panel 122 is similar to the lower panel member 14 of FIG. 2, inlcuding the L-shaped portion 16. The primary distinction is that the lower panel 122 includes an elongated slot 104 which extends along the length of the lower panel. A hollow cross-section 126 of any desirable shape, such as for example an L-shape, as shown, may be provided to reduce the weight of the lower panel. A plurality of holes 128 are provided along the lower panel at desired locations, such as at corner sections similar to sections 63 and 65, as shown in FIG. 3. Holes 130 may also be provided along L-shaped portion 132 for receiving a fastener 160 for affixing the upper panel 124 through holes 125. It is also within the scope of the invention to provide a hole in side 148 opposite hole 130. Any desired type of fastener, such as for example, an expansion rivet or bolt may be used.

The corrosion prevention apparatus 110 includes a channel bar 140 which fits over the base member 106. The channel bar 140 has a U-shaped channel 142 which is substantially the same width as the first side 114 of the base member 106. The channel bar 140 is placed over a second side 116 of the base member 106, opposite said first side 114, so that the channel bar 140 extends down to cover a portion of the third and fourth sides 118 and 120. The channel bar 140 includes a plurality of holes 144 which are placed to coincide with holes 128 in the lower panel and holes 121 in the base member 106. The channel 140 bar may be constructed of any fire resistant, hard, rigid, plastic material, such as for example, "Nylon" ® or any other material with these properties.

A securing device 150 is provided to secure the lower panel 122 to the base member 106, so that the lower panel is insulated from the base member. This securing device includes an insulating hollow sleeve member 152 which is received in holes 128, 144 and 121. The sleeve member may extend from one side 146 to the other side 148 of the lower panel 122. A fastening pin device 154 extends through the sleeve 152 and is fastened at both sides 146 and 148 of the lower panel, so as to secure the lower panel to the base member 106. The sleeve prevents the metal of the lower panel 122 from having electrical conductive contact with the base member 106 through the metal of the fastening pin 154. The fastening pin 154 may be constructed of an expansion rivet, as shown, or any other desired pin device such as for example, a bolt.

In constructing a bulkhead structure 100, a base member 106 is affixed to the deck by any desired means, such as for example, welding. Then a channel bar 140 is installed over the base member so as to cover a portion of the third and fourth sides 11 and 120 of the base member 106. Next, the lower panel 122 is placed on the channel bar so that the elongated slot 104 is received on the channel bar. An insulating hollow sleeve member 152 is inserted within the holes 128, 144 and 121. Then a fastener 154 is inserted within the sleeve member 152 and clamped against the two sides 146 and 148 of the lower panel 122. It is also within the scope of the invention to connect a quarter post or door frame to the lower panel 122 with the fastening device 154. The upper panel 124 may now be installed so that the L-shaped portions of the upper and lower panels interfit with one another and are fastened together. The upper panel may be connected to the lower panel with a fastener 160 which passes through holes 125 in the upper panel 124 and hole 130 in the lower panel 122. If desired, an H-post or a half H-post may be installed along the lower panel as illustrated in FIG. 1, and attached by any desired means, such as the fastener 160. Then the upper panel may be supported by the H-post as described in the first embodiment.

Thus, the corrosion prevention apparatus 110 significantly inhibits corrosion of the bulkhead structure since the galvanic action caused by water in contact with the different metals (the steel of the base member and the aluminum of the lower panel) is eliminated. Also, the current which may be provided in the panel means 102 from the electrical systems of the ship is electrically insulated from the deck, preventing corrosion of bulkhead to deck connection.

One skilled in the art will realize that there has been disclosed a bulkhead structure that prevents corrosion, simplifies construction and disassembly, and is relatively inexpensive to manufacture and install.

While there has been described what is at present considered a preferred embodiment of the invention, it will be obvious to those skilled in the art that various changes and modifications may be made therein without departing from the invention, and it is, therefor, aimed in the appended claims to cover all such changes and modifications as follow in the true spirit and scope of the invention.

What is claimed is:

1. A bulkhead structure for partitioning a deck, comprising:

a. lower panel means for partitioning said deck, said lower panel means having an elongated slot at one end thereof for receiving;

b. base member means affixed to said deck for supporting said lower panel means; and c. upper panel means for interconnecting with said other end of said lower panel means;

d. corrosion prevention means between said lower panel means and said base member means for inhibiting corrosion of said bulkhead structure.

2. The bulkhead structure as defined in claim 14, further characterized in that said corrosion prevention means prevents direct contact between said base member means and said lower panel means.

3. The bulkhead structure as defined in claim 2, further characterized in that said corrosion prevention means is a channel bar which fits over said base member means.

4. The bulkhead structure as defined in claim 3, further characterized in that said corrosion prevention means is formed of a non-metalic material.

5. The bulkhead structure as defined in claim 4, further characterized in that said base member means is an elongated plate having four sides with a substantially rectangular cross-section whereby a first side of said base member means is affixed to said deck.

6. The bulkhead structure as defined in claim 5, further characterized in that said channel bar has a U-shaped channel, said channel is substantially the same width as said first side and is placed over a second side of said base member means opposite said first side, whereby said channel bar extends down to cover a portion of the third and fourth sides.

7. The bulkhead structure as defined in claim 6, wherein said first end of said lower panel includes said elongated slot, said elongated slot having a cross-section for tightly receiving said channel bar.

8. The bulkhead structure as defined in claim 7, wherein said means for securing said lower panel to said base member means insulates said lower panel from said base member.

9. The bulkhead structure as defined in claim 8, wherein said means for securing includes said lower panel, said channel bar and said base member having a plurality of holes therethrough, and insulating hollow sleeve member provided in said holes and fastening pin means extending through said sleeve fastened at both sides of said lower panel for securing the lower panel to the base member means.

10. The bulkhead structure as defined in claim 9, further characterized in that said corrosion prevention means is formed of nylon or similar material.

11. The bulkhead structure as defined in claim 10, further characterized in that said fastening pin means is a rivet.

12. The bulkhead structure as defined in claim 11, wherein said means to interconnect said upper and lower panels comprises interfitting L-shaped portions of said respective panels.

* * * * *